US005310089A

United States Patent [19]

Hudgins

[11] Patent Number: 5,310,089

[45] Date of Patent: May 10, 1994

[54] LIQUID DISPENSING SYSTEM

[76] Inventor: Richard G. Hudgins, 1852 N. Wilton Pl., No. 6, Hollywood, Calif. 90028

[21] Appl. No.: 35,069

[22] Filed: Mar. 22, 1993

[51] Int. Cl.[5] ..... A63H 3/18

[52] U.S. Cl. ..... 222/79; 222/321; 222/325; 222/333

[58] Field of Search ..... 222/321, 325, 211, 464, 222/79, 383, 333

[56] References Cited

U.S. PATENT DOCUMENTS

| | | | |
|---|---|---|---|
| 4,154,375 | 5/1979 | Bippus | 222/325 |
| 4,821,923 | 4/1989 | Skorka | 222/80 |
| 4,995,534 | 2/1991 | Norman | 222/464 X |
| 5,011,046 | 4/1991 | Graf et al. | 222/321 |
| 5,100,030 | 3/1992 | Roggenburg et al. | 222/325 X |
| 5,123,573 | 6/1992 | Kucherer | 222/321 X |
| 5,156,299 | 10/1992 | De Caluwe et al. | 222/325 X |

*Primary Examiner*—Gregory L. Huson
*Attorney, Agent, or Firm*—Jack C. Munro

[57] ABSTRACT

A liquid dispensing system which is designed to use a single pump in conjunction with a plurality of liquid containing containers. The pump can be either manually or electrically operated. Associated with each container is a dispensing valve which prior to usage is closed by a cap preventing leakage of liquid from the container. Once the cap is removed a connector on the pump can be matingly connected to the dispensing valve in a liquid tight manner and subsequent operation of the pump will cause dispensing of the liquid into the ambient. The pump can be covered by a cover which is fixed to the container. An access opening is provided within the cover so as to manually operate the pump. An outlet tube extends from the pump to an outlet hole in the cover. This outlet tube flexes during operation of the pump. The pump and container can be formed into a pistol type configuration. There can be a special shaped connecting configuration between the pump and the dispensing valve to eliminate usage of one manufacturer's liquid product with another manufacturer's pump.

4 Claims, 3 Drawing Sheets

LIQUID DISPENSING SYSTEM

BACKGROUND OF THE INVENTION

1. Field of the Invention

The field of this invention relates to dispensing systems which deliver aqueous and alcohol product or high viscosity formulations, and more particularly to an atomizing spray type dispensing system to be used to affect dispensing into the ambient of a liquid medium.

2. Description of Prior Art

Dispensing devices which include atomizing types of pumps, both aerosol and non-aerosol, which dispense consumer product liquids such as colognes, perfumes, antiperspirants, hair sprays, liquid soaps and other types of liquids have long been known. Within recent years, it has been determined that the use of aerosol dispensing containers is hazardous to the ozone layer of the earth. Therefore, aerosol types of liquid dispensing systems are being replaced by non-aerosol types of dispensing systems. Basically, the non-aerosol type of dispensing system, instead of using a gas propellant, utilizes a mechanical force in order to affect the atomization of the liquid. Required mechanical force can be applied manually, or by an electrically operated motor or solenoid utilizing AC or DC current.

Currently there are numerous liquid dispensing systems on the market. Few of these dispensing systems offer a coordinated refill capability. Known to the art, commercially available pumps which are utilized in the current dispensing systems have use-life cycle of hundreds of thousands of activations without failure. The established concept of one pump, one container, utilizes the pump only a few hundred times. It should be noted the cost of the pump is a major cost factor of most dispensing systems. Some companies do provide refill containers of their liquid which is to be utilized as refill for their dispensing system container. However, many companies have not supported the refill program. One objection is that the consumer is inclined to refill an original purchase dispensing container with a competitor's product.

Another major deterrent to the refilling of atomizing dispensing containers is the inconvenient sequence of mechanical manipulation of the refilling procedure: 1) Remove, by unscrewing, pump/container closure from empty liquid container; 2) Remove sealing cap of the liquid refill container; 3) Pour refill liquid into original container; 4) Reset pump/container closure in conjunction with original dispensing container; 5) Reseal refill container; 6) Clean up any spilled residue.

Many modern day consumers consider this refilling procedure to be too messy and too time consuming. Why not just purchase a new unit even though it may be more expensive and never mind that the discarded empty creates more trash. The fact that the discarded pump has a remaining life cycle usability factor capable of evacuating numerous additional liquid containers is totally ignored.

SUMMARY OF THE INVENTION

One of the objectives of the present invention is to construct a liquid dispensing system which utilizes conservation and is ecologically preferred.

Another objective of the present invention is to utilize an individual host pump in support of a dispensing system, which has the capability to dispense in sequence a multitude of liquid containers rather than only a single liquid container.

Another objective of the present invention is to construct an atomizing liquid dispensing system which substantially diminishes the overall cost of such a system in comparison to prior art types of atomizing liquid dispensing systems.

The dispensing system of the present invention uses a single pump in conjunction with a plurality of liquid containers. Each liquid container includes a single access opening through which the container is filled with a desired amount of liquid. This access opening snap fittingly receives a dispensing valve. Until it is time to utilize the specific container, the dispensing valve is sealed by a cap which is also snap-in position in conjunction with the dispensing valve. After filling and before usage, the seal cap also may be utilized as a tamper identifying seal. The cap is to be removed when it is desired to attach the container with the connector of a pump being matingly connected to the dispensing valve. Normally, in the prior art, the pump carries an inductor tube which is insertable within the container that contains the liquid. Within this invention, the inductor tube is carried by the dispensing valve as an in situ installation. Due to the novel configuration of this invention, the dispensing pump can be used to evacuate a plurality of liquid containers with the pump being readily interchangeable from container to container as a snap together connect/disconnect procedure. The pump may be enclosed by a cover which is fixed to the container. Interconnecting the outlet opening of the cover and the pump is a flexible tube so as to permit the reciprocating motion of the pump to achieve the dispensing of the liquid by having the flexible tube deflect yet maintaining a liquid-tight connection between the pump and the outlet opening of the cover. The liquid dispensing system of this invention can be constructed in a pistol configuration. When in the pistol configuration, the pump can be operated electrically or manually, and also features the interchangeable liquid container of the present invention.

DETAILED DESCRIPTION OF THE SHOWN EMBODIMENT

Figure 1:
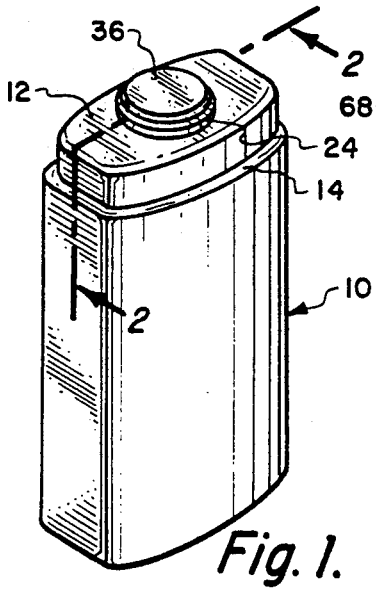
FIG. 1 is an isometric view of a typical liquid container utilized in conjunction with the dispensing system of the present invention.

Referring particularly to the drawings there is shown in FIG. 1 the dispensing container 10 utilized in conjunction with the liquid dispensing system of this invention. The dispensing container 10 is depicted generally rectangular but with the largest sidewalls being slightly rounded. This shaping of the container 10 is for aesthetic reasons and also to facilitate manual grasping and utilization of the container 10. It is considered to be within the scope of this invention that the container 10 can be designed to be of any desired shape, size or configuration.

Figure 5:
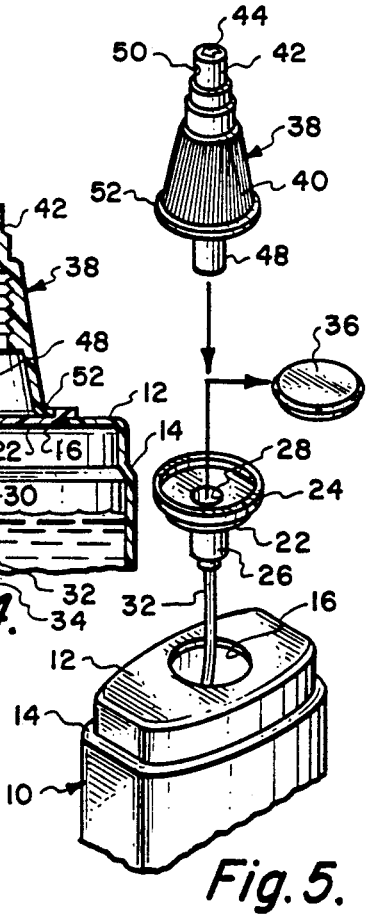
FIG. 5 is an exploded isometric view showing the pump of FIG. 3 in relation to the dispensing valve of the container to which it is to be connected and graphically depicting the simple connect/disconnect assembly described in FIG. 4.

The upper portion of the container 10 includes a necked down section 12 with an enclosing ledge 14 being formed between the necked down section 12 and the remaining portion of the container 10. Within the top wall of the necked down section 12 there is located an access opening 16 (FIG. 5). The access opening 16 provides for the supplying of liquid 18 to within internal compartment 20 of the container 10.

Figure 9:
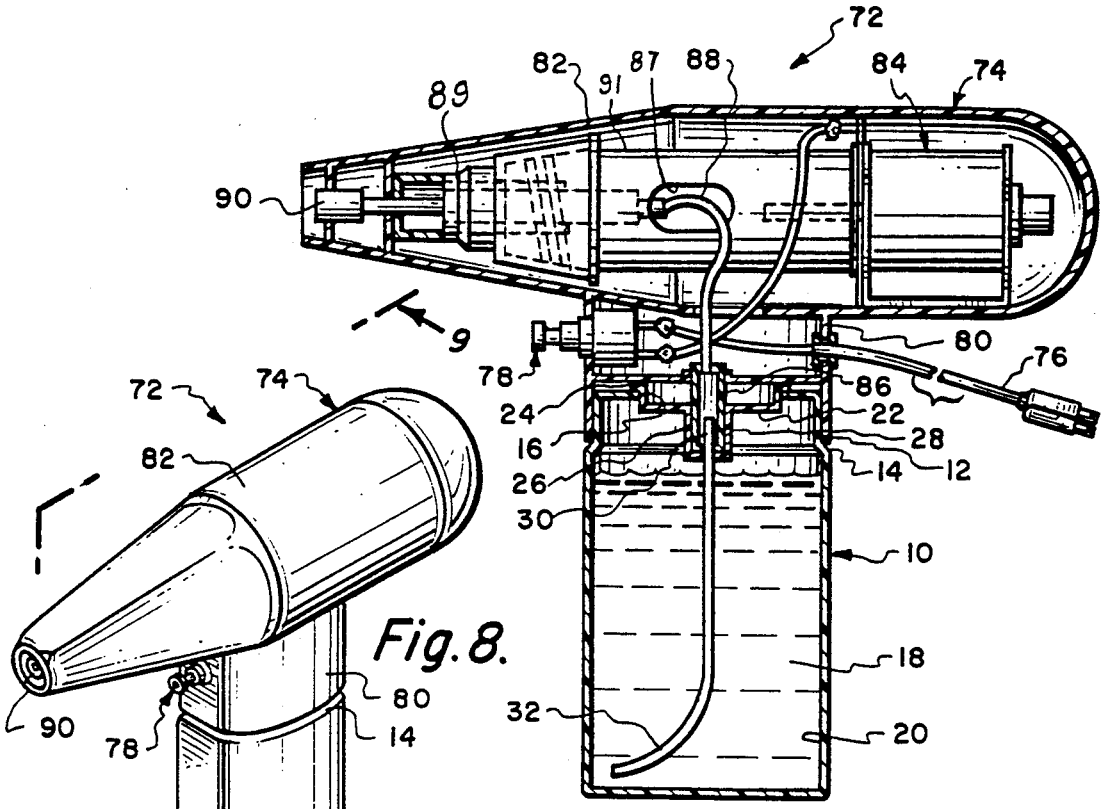
FIG. 9 is a cross-sectional view taken along line 9—9 of FIG. 8.
Figure 11:
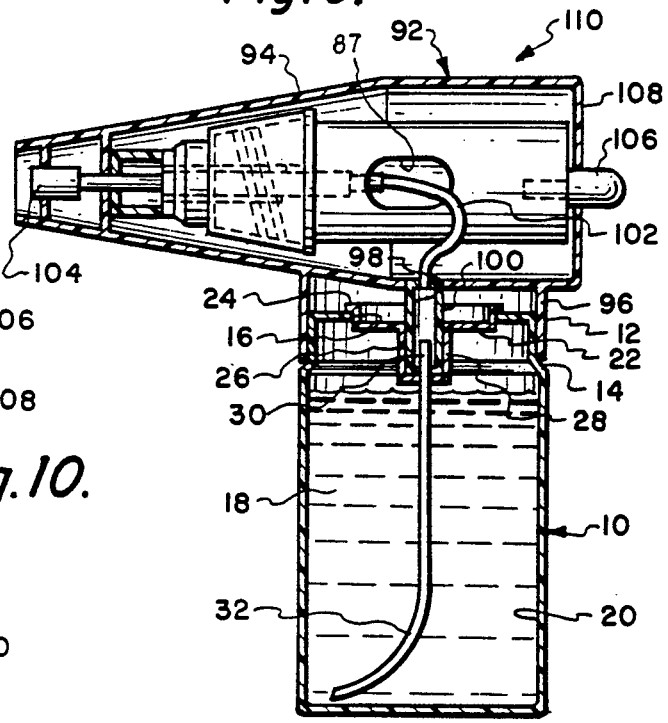
FIG. 11 is a cross-sectional view taken along line 11—11 of FIG. 10.

The access opening 16 is designed to receive in a press fitting, liquid-tight relationship a dispensing valve which includes a cup 22. The exterior sidewall of the cup 22 is designed to be force fitted within the access opening 16 with the annular ledge 24 resting against the exterior surface of the top wall of the necked down section 12. Centrally, integrally formed with the cup 22 is a cylindrical extension 26. Within the extension 26 is formed a cylindrically shaped recess 28 which functions as a valve seat. Extending within the recess 28 is an upper section 30 of an inductor tube 32. The inductor tube 32 can be made integral with the cylindrical extension 26 or can be made separate therefrom as is shown in FIGS. 9 and 11. In FIGS. 9 and 11, when it is separate, a tight-sealing connection is established between the inductor tube 32 and the cylindrical extension 26 when it is installed in place. But it is important that there always be a section 30 of the tube 32 that extends within the confines of the recess 28.

There may be included within the cup 22 a vent opening which is not shown. Upon requirement, the purpose of the vent opening is to permit air to enter the internal chamber 20 as liquid 18 is withdrawn. Liquid 18 is withdrawn through the longitudinal through opening 34 formed within the inductor tube 32. Normally the inductor tube 32 will extend all the way to the bottom of the container 10 as is clearly shown in FIGS. 9 and 11 of the drawings.

It is to be restated that the cup 22 is snappingly inserted in conjunction with the access opening 16. No other type of securement is required other than the press fit established between the cup 22 and the wall of the access opening 16. Should additional positive bond be desired, glue or welding techniques may be utilized.

Prior to usage of a container 10, the cup 22 will be sealed from the ambient by means of a cap 36. The cap 36 is to be similarly press fitted within the cup 22 and can also be utilized as a tamper identification seal. The cap 36 is to be removed prior to installation of the pump 38 shown in FIGS. 3 to 5 of the drawings. The pump 38 is deemed to be conventional and can be purchased from various manufacturers. One such manufacturer being Calmar, Inc. of 40 Sterling Road, Watchung, N.J.

Known configurations of available conventional pumps feature a screw-on connection between the pump and the liquid container. This system dictates that the pump shroud closure housing 40 be of a circular design to conform with the circular configuration of the raised protruding neck of the liquid container. A patentable feature of this invention is the snap-together connection between the pump 38 and liquid container 10. This system doesn't require a container 10 with a protruding neck, thereby eliminating the requirement for a pump with a circular shroud closure (housing 40). Under the system of the present invention, a conventional type pump of custom design/manufacture can feature an exterior housing/shroud closure not only with a circular base; but as alternates, most geometric forms: oval, polygon, polyhedron, square, rectangle, etc.. All connective parts would be of a similar compatible configuration as required to retain the integrity of the present invention.

The pump 38 comprises an exterior housing 40 within which is movably mounted a plunger 42. The plunger 42 has a top 44 to which manual pressure is to be applied to depress the plunger 42. The depressing of the plunger 42 is against the bias of a spring 46. When the plunger 42 is released and pressure is no longer being applied, the force of the spring 46 causes the plunger 42 to return to its uppermost position shown in FIGS. 3, 4 and 5 of the drawings.

The lower end 48 of the plunger 42 has an internal opening within which is snuggly received the upper end 30 of the inductor tube 32. Manual depressing of the plunger 42 causes a suction to be created within through opening 34 which tends to draw some of the liquid 18 up into the confines of the plunger 42. This causes some of that liquid to be discharged into the ambient through an outlet hole 50 formed within the plunger 42. The lower end of the housing 40 includes an annular flange 52 which is to rest within confines of annular ledge 24 in a snug fitting manner. It is to be readily understood that the pump 38 can be readily disengaged from a specific container 10 and reinstalled on another container 10. This reinstallation procedure allows for pump 38 to be transfered from one container 10, whether empty or not, to an alternate container 10, and its liquid 18 may or may not be identical to liquid 18 of the first noted container 10. In the situation when container 10 is not empty, the cap 36 would be normally reinstalled in conjunction with the cup 22.

Lower end 48 could be manufactured in a specific exterior shape such as a diamond, triangular, octagonal, etc.. The specific shape must be located in a similar mating shape of recess 28. A particular shape would be proprietary to a single manufacturer thereby restricting the use of their product container 10 with their own pump 38.

It is to be considered to be within the scope of this invention that lower end 48 could have an extension resembling the induction tube 30. In such an instance, the induction tube 30 would not extend within recess 28 but there would be a smaller recess adjoining recess 28 that the inductor tube extension would snuggly fit into.

Figure 6:
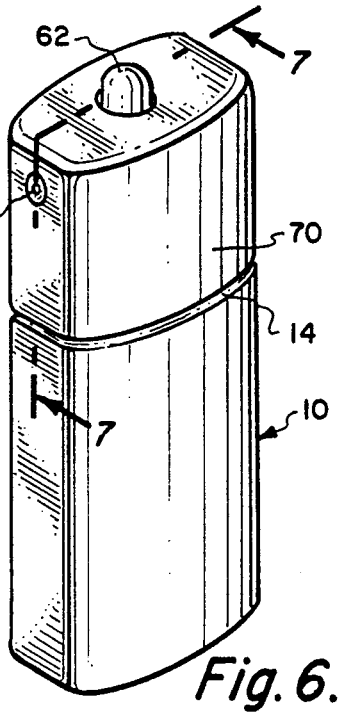
FIG. 6 is an isometric view of a modified version of the pump and container of this invention showing a cover which encases the pump.
Figure 3:
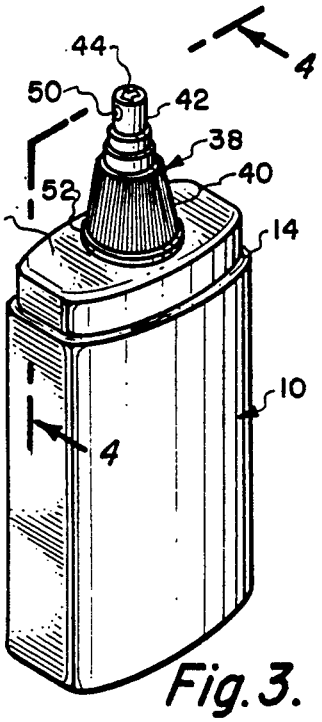
FIG. 3 is a view similar to FIG. 1 but showing the cap removed and a conventional atomizing pump device connected to the container.
Figure 2:
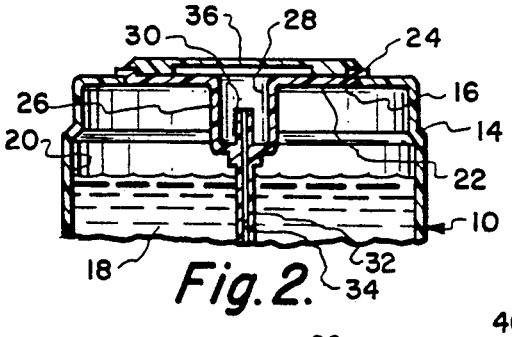
FIG. 2 is a cross-sectional view taken along line 2—2 of FIG. 1 showing the cap in position in conjunction with the container closure (dispensing valve) which seals the container from the ambient.
Figure 7:
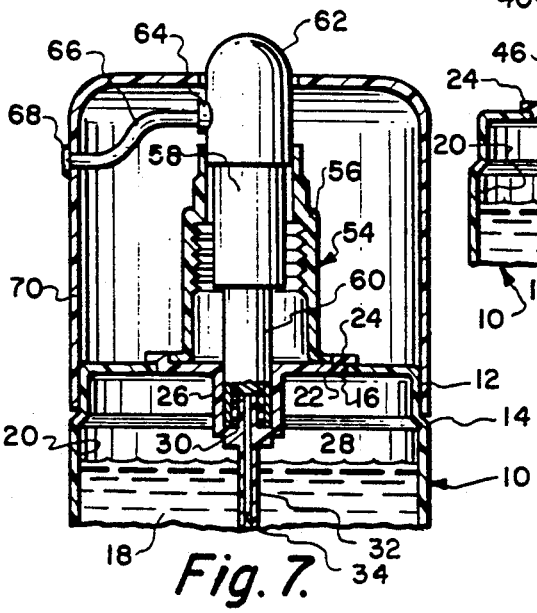
FIG. 7 is a cross-sectional view through the modified version of the pump and container of this invention taken along line 7—7 of FIG. 6.
Figure 4:
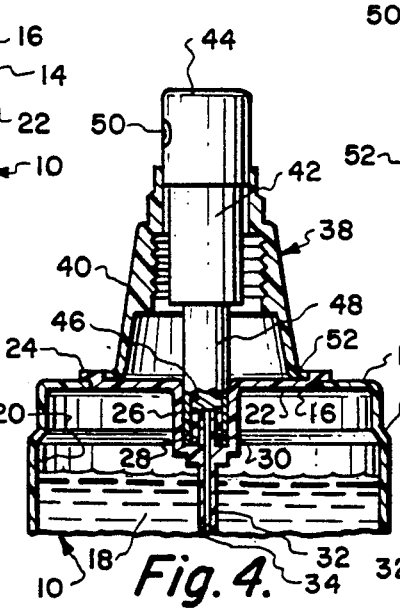
FIG. 4 is a cross-sectional view through the pump and container of FIG. 3 taken along line 4—4 of FIG. 3 indicating the simple connect/disconnect connection between the pump device and the container closure/dispensing valve and its carried in situ inductor tube.

Referring specifically to FIGS. 6 and 7 of the drawings, there is shown a modified version of pump 38 which is called out as pump 54. Pump 54 includes an exterior housing 56 which is basically similar to housing 40. Pump 54 includes a plunger 58 which is again basically similar to plunger 42. Plunger 58 has a lower end 60 which is basically similar to lower end 48. The lower end 60 has an internal opening which is to connect with the upper end 30 of the inductor tube 32. The outer actuating end 62 of the plunger 58 is rounded as opposed to being flat as shown in FIGS. 3 to 5. Depressing manual pressure is to be applied to rounded end 62 forcing the plunger 58 in a downward direction which will result in extracting of the liquid 18 from within the internal compartment 20 and discharging such through the outlet opening 64. However, the outlet opening 64 in this instance is connected to a flexible outlet tube 66. This flexible outlet tube 66 is connected to an outlet 68 formed within an encasing cover 70. The encasing cover 70 is fixedly secured around the necked down section 12 in a tight-fitting manner. However, the pump 54 is carried by the cover 70 and therefore separating of the cover 70 from the container 10 will effect removal of the pump 54 from the upper section 30 of the inductor tube 32.

The advantage of the structure of FIGS. 6 and 7 as opposed to FIGS. 3, 4 and 5 is that the position of the outlet 68 is fixed where the outlet 50 moves vertically. Therefore, more accurate placement of the dispersed liquid from the outlet 68 is obtained within the embodiment shown in FIGS. 6 and 7 of the drawings. The reciprocating action of the plunger 58 is accommodated by the flexibility within the outlet tube 66.

Figure 8:
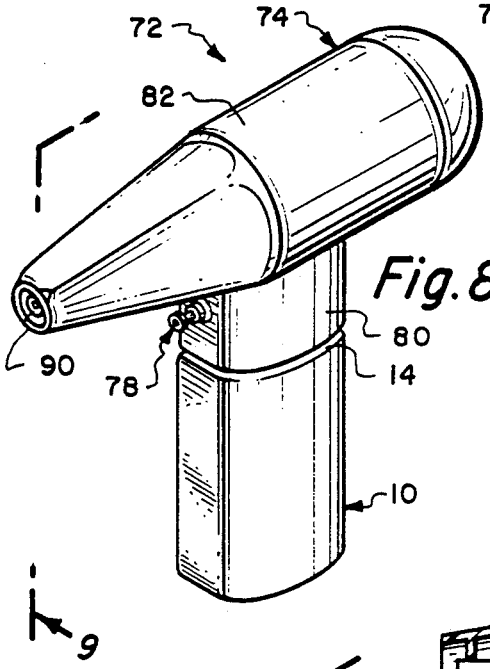
FIG. 8 shows an isometric view of a solenoid operated pistol grip configuration of the liquid dispensing apparatus of the present invention.

Referring particularly to FIGS. 8 and 9 of the drawings, there is shown a pistol shaped liquid dispensing apparatus 72. Basically, the same container 10 is utilized. The dispenser 74 is to be electrically operated from a source of electricity supplied by electrically conducting line 76 or battery, not shown. The line 76 connects through a manually operated switch assembly 78 which is mounted within lower end 80 of the pump housing 82. The lower end 80 is to snuggly mount on the necked down section 12 in the same manner as cover 70 (FIG. 7) was so mounted. From the switch 78 the electrical energy is supplied to a solenoid 84. Solenoid 84 with hollow adapter extension 91 which has a side access hole 87 allowing for connection with pump mechanism 89, which is screw-mounted to the adapter extension mechanism 91. Screw-mounting allows for easy replacement of the pump. Activation of the solenoid 84 causes liquid 18 to the moved through inductor tube 32 within sleeve 86 which is mounted in a liquid tight manner in conjunction with the recess 28. From within sleeve 86 the liquid is conducted through tube 88 and then dispensed through fixed position nozzle 90. The actual construction of the solenoid 84 is deemed to be conventional. With each depressing of the switch 78, a single spray quantity will be emitted from the nozzle 90 or solenoid can be programmed for repetitive action response.

Figure 10:
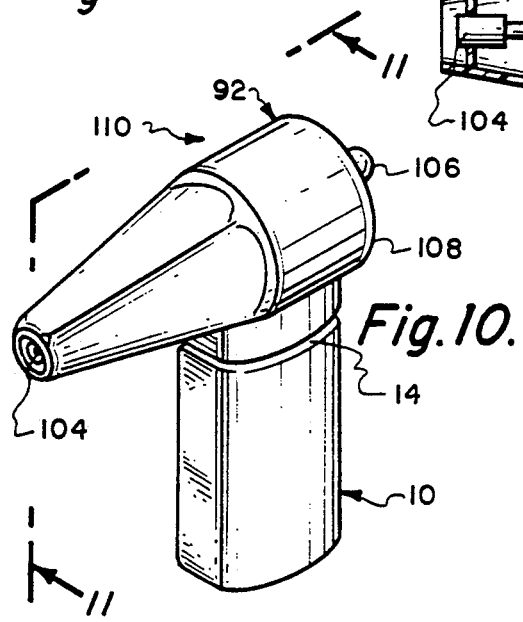
FIG. 10 is an isometric view similar to FIG. 8 but of a manually operated pistol configuration of the liquid dispensing apparatus of this invention.

Referring particularly to FIGS. 10 and 11 of the drawings, there is shown a different type of dispenser 92 mounted on the container 10. The dispenser 92 is basically similar to dispenser 74 in that there is a main pump housing 94 and a pump housing extension 96. The extension 96 is mounted on the necked down section 12. The liquid 18 from the inductor tube 32 is drawn through tube 32 into chamber 98 of sleeve 100. From sleeve 100, the liquid is conducted through tube 102 and through fixed position nozzle 104 and is atomized into the ambient. The drawing of the liquid into tube 102 is accomplished manually by pushing inward on button 106 mounted within the back wall 108 of the housing 94. The dispensing apparatus 110 of FIGS. 10 and 11 is basically similar to that of FIGS. 8 and 9 with the exception that it is manually operated. The deflection movement of the plunger associated with the pump incorporated within the pump housing 94 is accommodated for by the flexibility of the tube 102. This is also true for tube 88 in the dispensing apparatus 72. The exterior configuration of the dispensing apparatus 110 is basically similar to that of dispensing apparatus 72 shown in FIGS. 8 and 9. This configuration is that of a pistol shape. This pistol configuration offers reinforced responsiveness to operator requirements, assures ease of operation, and firmness of control. In other words, user friendly for delivery of non-aerosol personal care products such as hair sprays, styling spritz, and spray gels. Numerous other products which will be attracted to the interchangeability liquid container concept are not to be ruled out.

Figure 12:
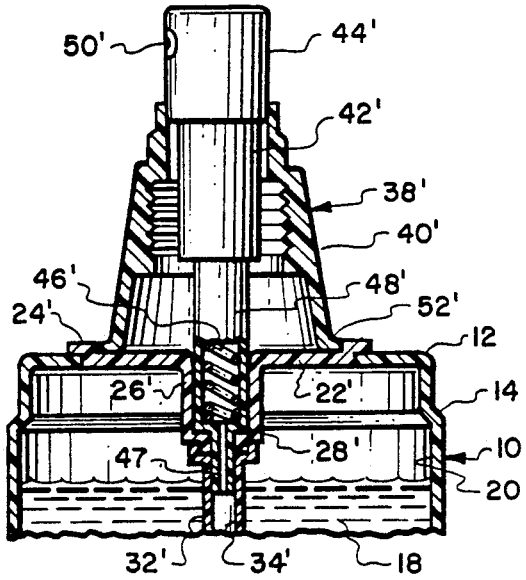
FIG. 12 is a cross-sectional view through a further modified version of the pump and container of this invention.
Figure 13:
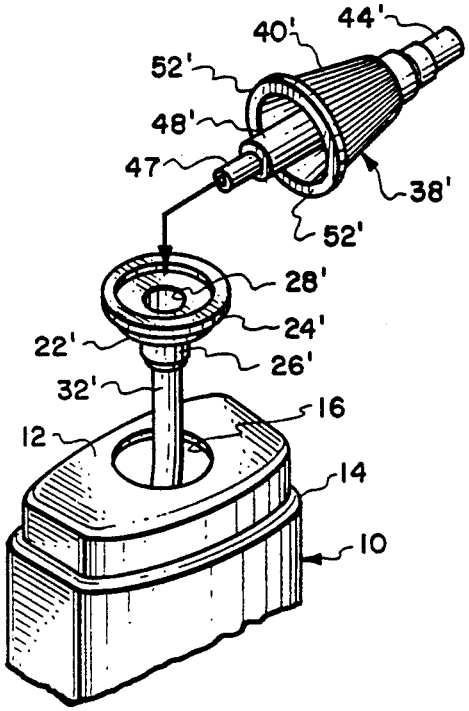
FIG. 13 is an exploded isometric view of the modified version of the pump and container as shown in FIG. 12.
Figure 14:
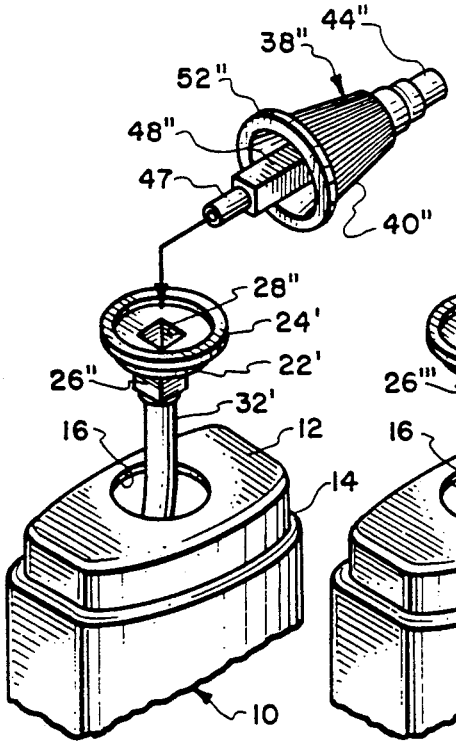
FIGS. 14 to 16 are views similar to FIG. 13 but of modifications of the connection between the pump and the valve seat of the container showing how uniqueness can be obtained for a specific manufacturer so that only a particular manufacturer's pump can be utilized with a particular manufacturer's product containing container.

Referring particularly to FIGS. 12 and 13 there is shown a further modified form of pump 38' of this invention. In reference to FIGS. 12 to 16 like numerals have been utilized to refer to like parts. Within FIGS. 12 and 13, the pump 38' has an exterior housing 40' within which is movably mounted a plunger 42'. The plunger 42' has a top 44' to which manual pressure is to be applied to depress the plunger 42'. The depressing of the plunger 42' is against the bias of a spring 46'. When the plunger is released and pressure is no longer applied, the force of the spring 46' causes the plunger 42' to return to its uppermost position shown in FIG. 12 of the drawings. Associated with the plunger 42' is an outlet hole 50'. The lower end of the housing 40' includes an annular flange 52' which is to rest within the annular ledge 24' of the dispensing valve which includes a cup 22'. Centrally, integrally formed within the cup 22' is a cylindrical extension 26'. Within the extension 26' is formed a cylindrically shaped recess 28' which functions as a valve seat. The annular ledge 24' is to rest against the exterior surface of the top wall of the neck down section 12 of the container 10 with the exterior sidewall of the cup 22' to be designed to be force fitted within the access opening 16.

The distinction of the modification shown within FIGS. 12 and 13 is that there is no upper section 30 of the inductor tube 32'. Instead, the lower end 48' of the plunger 42' has a smaller diametered in cross section extension 47. This extension 47 is to matingly fit in a liquid tight manner within the longitudinal through opening 34' of the inductor tube 32'. The inductor tube 32' is fixedly secured to the cylindrical extension 26'.

Referring particularly to FIGS. 14 to 16 again like numerals have been utilized to refer to like parts. The lower end 48'' of the plunger (not shown in FIG. 14) assumes an exterior configuration which is not round but which is square. This square configuration is to matingly connect within an appropriate square shaped recess 28''. This means that only a pump 38'' will connect with a specific valve of a container 10. The square configuration for the lower end 48'' can be the exclusive property of a particular manufacturer insuring that only the pump 38'' is to connect with that specific manufacturer's container 10.

Figure 15:
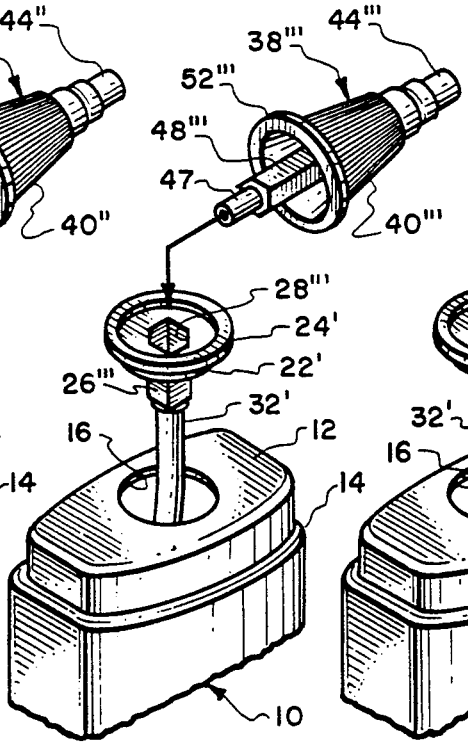
Figure 16:
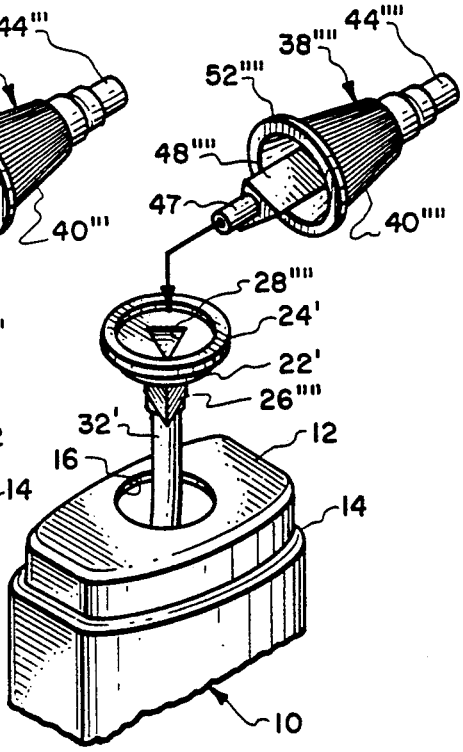

In a similar manner within FIG. 15 lower end 48''' is shown to be of a hexagonal shape which is to connect only with a hexagonal shaped recess 28'''. Within FIG. 16, the lower end 48'''' is shown to be of a triangular shape which is to connect with only a triangularly shaped recess 28''''. These are only examples of possible shapes of lower end 48 to 48'''' with it being understood that numerous additional shapes could be used.

What is claimed is:

1. A liquid dispensing system comprising:

a first container having an internal compartment, said internal compartment adapted to contain a quantity of a liquid to be dispensed, said first container having a single access opening providing access into said internal compartment;

a dispensing valve mounted in conjunction with said single access opening, said dispensing valve having an inductor tube, said inductor tube extending within said internal compartment and adapted to conduct therethrough the liquid contained within said internal compartment, said dispensing valve having a valve seat with a portion of said inductor tube projecting exteriorly of said internal compartment and within said valve seat, pump means operable to dispense a liquid, said pump means including a connector, said connector to matingly engage with said valve seat forming a liquid tight connection there between, said pump means being normally disengageable from said valve seat to permit said pump to reconnect with a second container;

said dispensing valve being secured by being force fitted within said single access opening; and there being a said second container, said second container being identical to said first container, said dispensing valve of said second container being covered by a cap, said cap being press fitted with said dispensing valve, said cap preventing leakage of the liquid contained within said second container prior to connection with said pump means.

2. A liquid dispensing system comprising:

a first container having an internal compartment, said internal compartment adapted to contain a quantity of a liquid to be dispensed, said first container having a single access opening providing access into said internal compartment;

a dispensing valve mounted in conjunction with said single access opening, said dispensing valve having an inductor tube, said inductor tube extending within said internal compartment and adapted to conduct therethrough the liquid contained within said internal compartment, said dispensing valve having a valve seat with a portion of said inductor tube projecting exteriorly of said internal compartment and within said valve seat, pump means operable to dispense a liquid, said pump means including a connector, said connector to matingly engage with said valve seat forming a liquid tight connection there between, said pump means being normally disengagable from said valve seat to permit said pump to reconnect with a second container; and said connection including an extension, said extension being smaller in cross section than said connector, said inductor tube including an internal through opening, said extension snugly fitting within said internal through opening.

3. A liquid dispensing system comprising:

a first container having an internal compartment, said internal compartment adapted to contain a quantity of a liquid to be dispensed, said first container having a single access opening providing access into said compartment;

a dispensing valve mounted in conjunction with said single access opening, said dispensing valve having an inductor tube, said inductor tube extending within said internal compartment and adapted to conduct therethrough the liquid contained within said internal compartment, said dispensing valve having a valve seat with a portion of said inductor tube projecting exteriorly of said internal compartment and within said valve seat, pump means operable to dispense a liquid, said pump means including a connector, said connector to matingly engage with said valve seat forming a liquid tight connection there between, said pump means being normally disengageable from said valve seat to permit said pump to reconnect with a second container;

said pump means being electrically operated; and said first container and said pump means assuming a pistol configuration.

4. A liquid dispensing system comprising:

a first container having an internal compartment, said internal compartment adapted to contain a quantity of a liquid to be dispensed, said first container having a single access opening providing access into said internal compartment;

a dispensing valve mounted in conjunction with said single access opening, said dispensing valve having an inductor tube, said inductor tube extending within said internal compartment and adapted to conduct therethrough the liquid contained within said internal compartment, said dispensing valve having a valve seat with a portion of said inductor tube projecting exteriorly of said internal compartment and within said valve seat, pump means operable to dispense a liquid, said pump means including a connector, said connector to matingly engage with said valve seat forming a liquid tight connection there between, said pump means being normally disengageable from said valve seat to permit said pump to reconnect with a second container;

said pump means including a manually operable repeatedly depressible plunger in order to affect dispensing of the liquid contained within said internal compartment; and said repeatedly depressible plunger being covered by a cover, said cover being fixedly mounted onto said container, said cover having an outlet opening, access being provided within said cover to permit manual operation of said plunger, an outlet tube extending from said plunger to said outlet opening, said outlet tube being flexible so as to permit operation of said plunger while dispensing of the liquid through said outlet tube.

* * * * *